United States Patent [19]

Cherry

[11] 4,305,186

[45] Dec. 15, 1981

[54] ONE PIECE ADJUSTABLE BODY SUPPORT FOR A CASKET

[76] Inventor: John R. Cherry, 1372 Knollwood Dr., Palm City, Fla. 33590

[21] Appl. No.: 109,967

[22] Filed: Jan. 7, 1980

[51] Int. Cl.[3] ..... A61G 17/00

[52] U.S. Cl. ..... 27/4

[58] Field of Search ..... 27/2, 3, 4; 5/82, 110, 5/111

[56] References Cited

U.S. PATENT DOCUMENTS

| | | | |
|---|---|---|---|
| 1,840,675 | 1/1932 | Letzig | 27/2 |
| 3,449,776 | 6/1969 | Brock | 5/82 |
| 4,123,831 | 11/1978 | Covington | 27/2 |

*Primary Examiner*—John D. Yasko

*Attorney, Agent, or Firm*—Olsen and Stephenson

[57] ABSTRACT

A one piece body support for use in a casket to support a body in a recumbent position. The body support is assembled from a unitary blank of paperboard and comprises a bed portion having integral length adjustable means enabling the length of the bed portion to be varied so that the body support can be adapted to be accommodated in caskets having different interior lengths. The length adjustable means comprises flexible end sections formed by transversely extending score lines. The flexible sections are foldable to vary the length of the bed portion while maintaining a generally constant vertical position for the bed portion.

13 Claims, 7 Drawing Figures

Fig-3
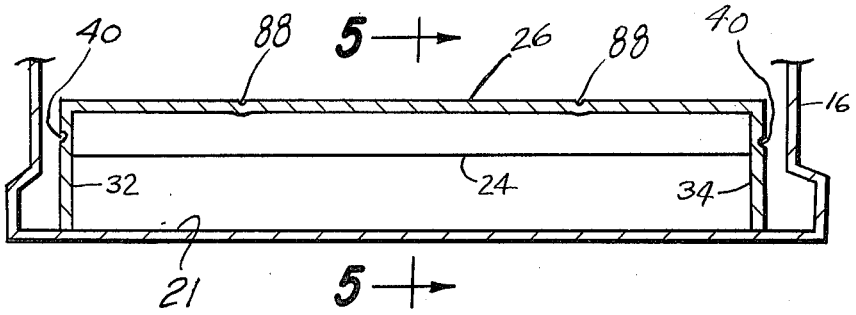
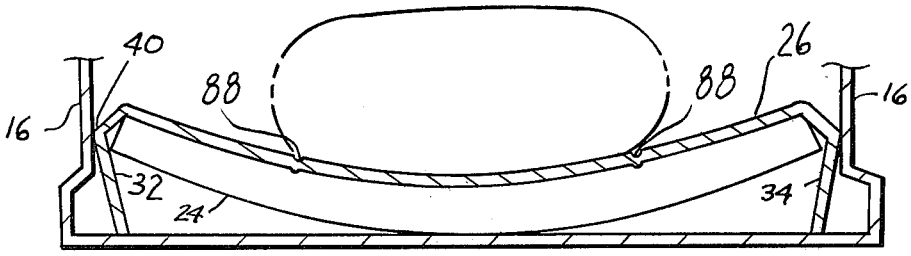
Fig-4
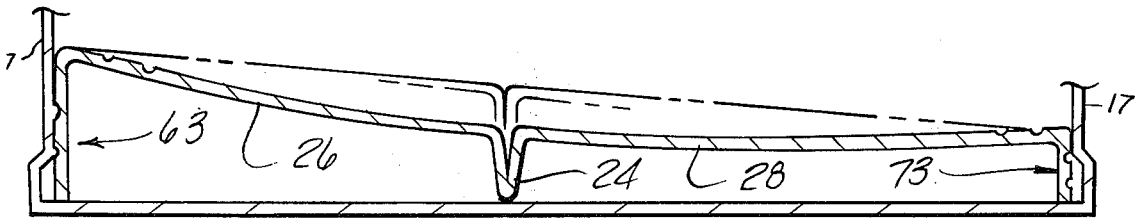
Fig-5
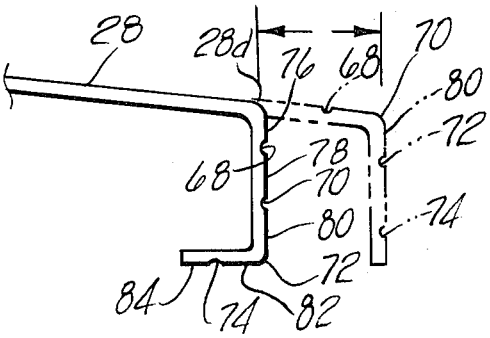
Fig-6

ONE PIECE ADJUSTABLE BODY SUPPORT FOR A CASKET

BACKGROUND OF THE INVENTION

The present invention relates generally to burial caskets, and more particularly, to a body support for a casket to support a corpse in a recumbent position. In co-pending application Ser. No. 045,789, filed June 5, 1979 now U.S. Pat. No. 4,253,206, applicant discloses a body support for a casket formed of semi-rigid sheet material such a paperboard. The body support disclosed in application Ser. No. 045,789 consists of a pair of bed sections placed end-to-end on transversely extending base members that are disposed sideways in the bottom of the casket. It is inexpensive and the pre-assembled blanks occupy only a small storage space.

There is still a need for a body support formed from semi-rigid material which can be adapted to be accommodated in caskets having varying interior lengths. Such a body support would be inexpensive, easy to assemble, and occupy only a small storage space and yet fulfill all of the service requirements presently established for body supports.

It is the general object of this invention, therefore, to provide a unitary body support formed from a semi-rigid sheet material that includes integral length adjustable means enabling the body support to be accommodated in caskets having varying internal lengths.

It is another object of the present invention to provide a body support which is restrained from sideways movement in a casket when a body is placed on the body support.

SUMMARY OF THE INVENTION

The present invention provides a body support formed from a unitary blank of semi-rigid sheet material such as double faced corrugated paperboard. The body support includes a bed portion having head and foot sections connected by a link section and depending sidewalls supporting the bed portion above the surface on which the body support is placed. The bed portion has integral length adjustable means enabling its length to be varied so that the body support will be accommodated in caskets having varying internal lengths, whereby the bed portion extends substantially over the entire length of the cakset in which it is disposed.

The integral length adjustable means includes flexible sections at the ends of the blank forming the bed portion which are selectively foldable to vary the length of the bed portion while essentially maintaining the vertical position of the bed portion regardless of the length of the bed portion. A first flexible section is in alignment with the generally horizontal top panels of the bed portion and a second flexible section is in a generally upright position normal to the first flexible section in the extended or longest configuration of the bed portion. The flexible sections are angularly movable from their respective horizontal and upright positions to shorten the length of the bed portion while maintaining its established vertical position.

Each of the side walls of the head and foot sections has a longitudinally extending score line located between the upper bed surface and the lower terminal end of the side wall. The score lines enable the side walls to flex or buckle outwardly when a body is placed on the body support so that the side walls press against the interior side walls of the casket thereby securing the body support in place and preventing its sideways movement.

The connecting link section is generally V-shaped and extends below the bed surface terminating at a position spaced above the bottom of the cakset. When a body is placed on the bed portion, the horizontal panels sag and the connecting link section moves downwardly into engagement with the bottom of the casket to provide added support at that location. Thus, a generally uniform slope from the head end to the foot end is provided for the bed portion when a body is placed on the body support.

Further objects, features and advantages of the present invention will become apparent from a consideration of the following description when taken in connection with the appended claims and the following drawing in which:

FIG. 3 is a cross sectional view of the body support of the present invention shown disposed in a casket without a body placed thereon and taken substantially from line 3—3 in FIG. 2;

FIG. 4 is a sectional view of the body support taken substantially from line 3—3 in FIG. 3 but showing its configuration after a body is placed thereon;

FIG. 5 is a longitudinal sectional view of the body support of the present invention taken substantially from line 5—5 in FIG. 3 showing in solid line the configuration of the body support when subjected to a load and in phantom line the configuration of the body support when not subjected to a load;

FIG. 6 is a fragmentary sectional view of the foot end of the body support illustrating the length adjustable means of the present invention.

Figure 1:
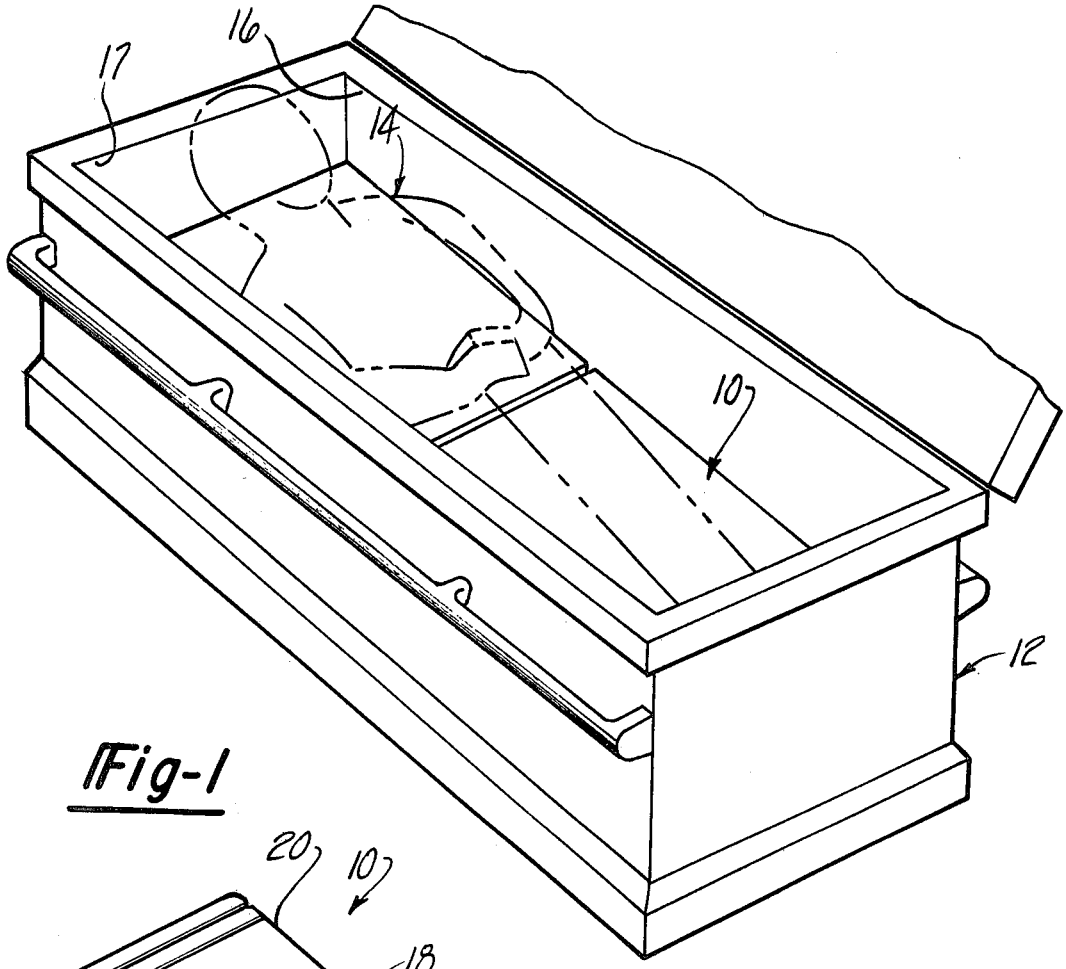
FIG. 1 is a perspective view showing a body positioned in a casket on the body support of the present invention.

Referring to the drawing, the body support of the present invention, indicated generally at 10 in FIG. 1, is shown disposed in a casket 12 supporting a corpse 14 in a recumbent position. The casket 12 includes side walls 16, end walls 17 and a bottom wall 20 (FIG. 3) with the body support 10 extending substantially over the entire length of the casket 12 between the end walls 17 and over substantially the entire width of the casket 12 between the side walls 16.

Figure 2:
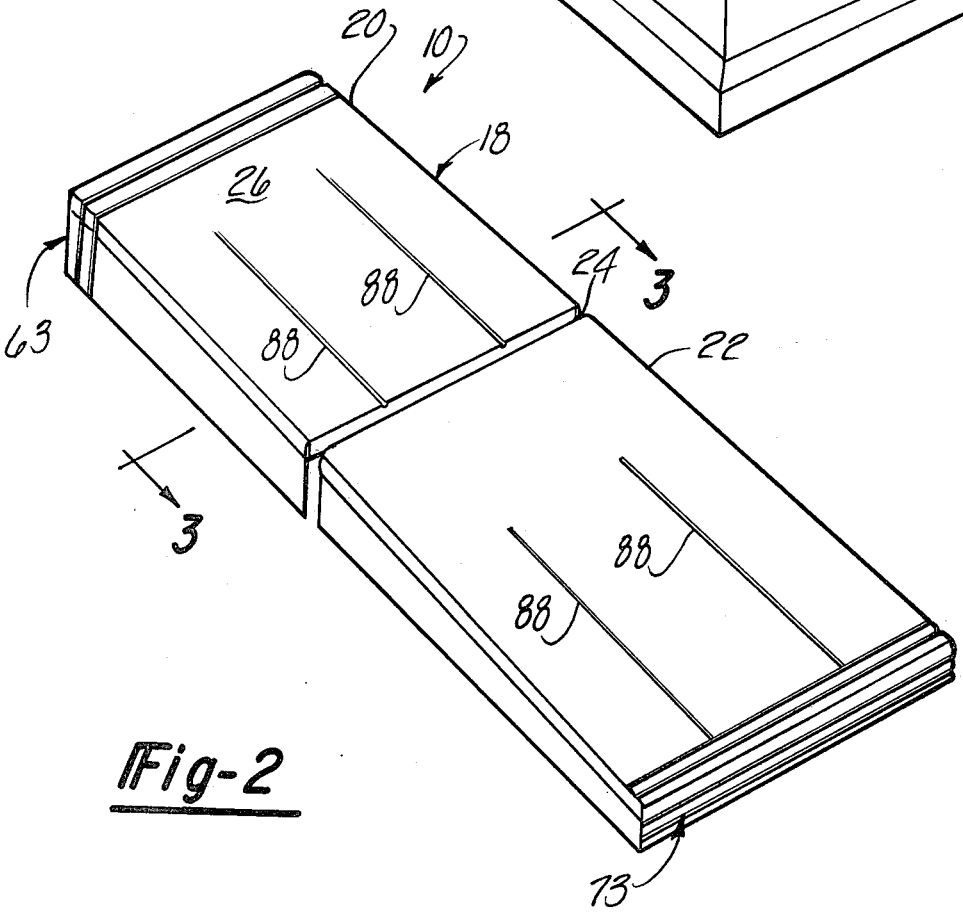
FIG. 2 is a perspective view of the body support of the present invention shown in its extended condition.
Figure 7:
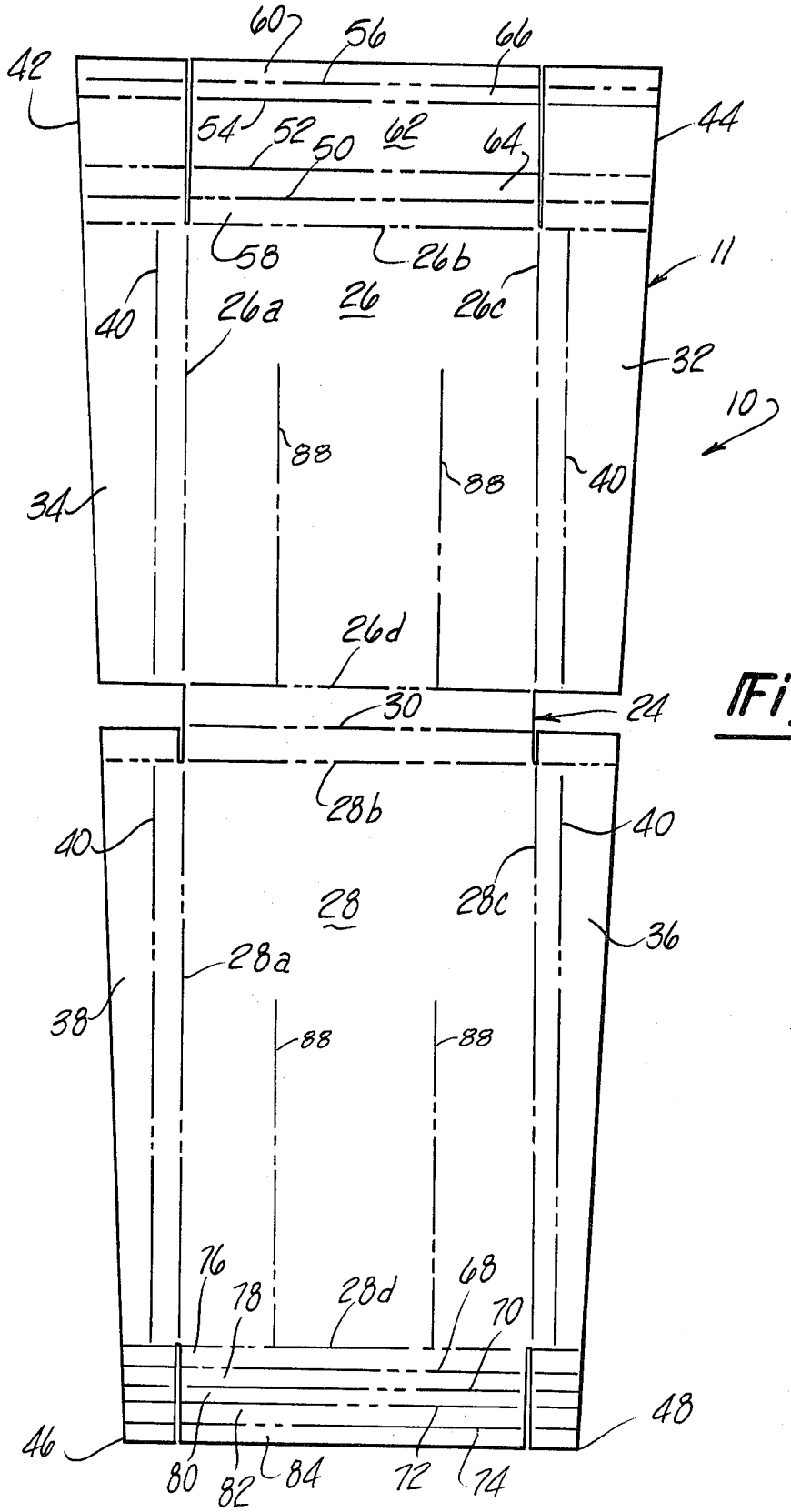
FIG. 7 is a plan view of a unitary blank of semi-rigid sheet material from which the body support of the present invention is assembled.

As shown in FIGS. 2 and 7, the body support 10 of the present invention is formed from a unitary blank 11 of semi-rigid sheet material such as corrugated double-faced paperboard. The body support 10 includes a bed portion 18 consisting of a head section 20 and a foot section 22 interconnected by a link section 24 that extends transversely with respect to the head and foot sections 20 and 22.

The head section 20 includes a generally rectangular top panel 26 defined by fold lines **26*a*–26*c* (FIG. 7). Likewise, the foot section 22 includes a generally rectangular top panel 28 defined by score lines 28*a*–28*d*. The connecting link section 24 has a transversely extending score line 30 centrally located between the score lines 26*d* and 28*b* so that when the body support is assembled, the link section 24 has a V-shaped configuration (FIG. 5**).

The panel 26 has depending side walls 32 and 34 and the foot section panel 28 has depending side walls 36 and 38. The blank 11 forming the body support 10 is cut so that the distances from the outer edges of the side walls 32–36 decrease progressively from the head end to the foot end of the bed portion 18 so that when the body support 10 is assembled, the bed surface defined by the top panels 26 and 28 will be slightly inclined so as to position the corpse 14 at the proper inclination for viewing purposes.

Each side wall 32, 34, 36 and 38 includes a longitudinally extending score line 40 that is generally parallel with its adjacent fold line 26*a*, 26*c*, 28*a* and 28*c*. Provision of these fold lines enables the side walls 32–28 to flex or buckle outwardly in response to the placement of a body 14 on the body support 10, as will be explained in greater detail below.

Cuts are made in the blank 11 in alignment with the score lines 26*a*, 26*c*, 28*a* and 28*c* extending up to the fold lines 26*d* and 28*d* to form flaps 42, 44, 46, and 48 which are foldable to a generally angular relationship with the side walls 32–38 when the body support 10 is assembled.

The body support 10 further includes integral length adjustable means enabling the length of the bed portion 18 to be varied to be accommodated in caskets 12 having a variety of interior lengths. The length adjustable means includes a plurality of flexible sections provided at the head and foot ends of the bed portion 18 which are selectively foldable to vary the length of the bed portion 18 while maintaining the established heights of the head and foot panels 26 and 28 and providing end support for the bed portion 18.

Referring to FIG. 7, the head section 20 has a plurality of transversely extending parallel score lines, indicated at 50, 52, 54 and 56. The fold lines 50 and 26*b* define a first flexible section 58, the fold line 56 and the end edge of the blank 11 define a second flexible section 60. The fold lines 52 and 54 define an intermediate section 62; the fold lines 52 and 50 and the fold lines 54 and 56 define auxiliary flexible sections 64 and 66. The distance between the fold line 26*b* and the fold line 50 essentially equals the distance between the end edge of the blank 11 and the fold line 56. The distance between the fold lines 50 and 52 approximately equals the distance between the fold lines 54 and 56.

A similar arrangement is provided at the foot end of the bed portion 18 except that the distances between the adjacent fold lines are shorter than those at the head end of the bed portion 18 to maintain the proper inclined relationship in all lengths of the bed portion 18. Transversely extending fold lines 68, 70, 72 and 74 are formed in the blank 11 at the foot end of the bed portion 18. Adjacent fold lines 28*d* and 68, 68 and 70, 70 and 72, 72 and 74, and 74 and the edge of the blank 11 define flexible end sections 76, 78, 80, 82 and 84 which are selectively foldable to vary the length of the bed portion 18 without affecting the height of the panel 28. The section 76 is a first flexible section, the section 84 is a second flexible section, 80 is an intermediate section and the sections 78 and 82 are auxiliary sections. The distance between the fold lines 28 and 68 equals the distance between the edge of the blank 11 and the fold line 74; the distance between the fold line 68 and the fold line 70 equals the distance between the fold lines 72 and 74. The flexible end sections at both the head and foot ends of the bed are foldable into upright end panels 63 and 73 which support the ends of the bed portion 18.

The body support 10 is assembled from the blank 11 by folding the side walls 32–38 downwardly to generally upright positions, as shown in FIGS. 2 and 3. The head section 20 and the foot section 22 are pushed together forming the V-shaped configuration of the connecting link 24. The connecting link section 24 extends below the panels 26 and 28 and terminates above the bottom 21 of the casket 12, as shown in FIG. 3, prior to the body support 10 being loaded with a body.

The body support 10 is shown in FIGS. 2 and 5 assembled in its longest or extended condition. The flexible end sections 58 and 64 are in horizontal alignment with the top panel 26. The intermediate section 62 and the remaining flexible sections 60 and 66 are folded downwardly as a unit at the fold line 52 and are in upright positions with the edge of the blank 11 resting on the bottom 20 of the casket 12. Similarly, at the foot end of the bed portion 18, the sections 76 and 78 are in horizontal alignment with the top panel 28 and the remaining sections 80, 82 and 84 are folded downwardly as a unit at the fold line 70 to upright positions. The flaps 42, 44, 46 and 48 are then folded to a face-to-face relationship with the upright end sections and secured thereto with adhesive or staple.

As shown in FIG. 6, the head and foot ends of the bed portion 18 can be folded a selected fold lines to vary the length of the bed portion 18 without varying the height of the panels 26 and 28. The extended position of the foot end body support 10 is shown in phantom in FIG. 6 and its shortest position is shown in solid line.

The body support 10 is converted to its shortest configuration by folding the end sections 58, 64 and the intermediate section 62 as a unit to upright positions at the fold line 26*b*. The sections 60 and 66 are then back folded at the fold line 54 to a position beneath the top panel 26. Thus, the folding of the end sections 58 and 64 angularly from their horizontal positions to upright positions is offset by folding the sections 60 and 66 beneath the panel 26 so that the established height of the panel 26 is maintained while support is still provided at the head end of the bed portion 18.

The foot end of the foot section 22 is converted to the shortest condition by folding the sections 76, 78 and 80 as a unit at the score line 28*d* to upright positions and folding the sections 82 and 84 as a unit at the fold line 72 beneath the panel 28. As can be seen in FIG. 6, the intermediate end section 80 remains upright in both the longest and shortest conditions of the body support 10 as well as any intermediate position. In the longest condition the intermediate section 80 is the top end sectior and in the shortest condition it is the lowest uprigh section. Likewise, the intermediate section 62 at the head end of the bed portion 18 always remains upright It is necessary in varying the length of the bed portior 18 to offset the folds made at the ends thereof to main tain substantially constant heights for the top panels 2 and 28. Thus, the heights of the end panels 63 and 73 ar such that they engage the bottom 20 of the casket 1 and provide support for the ends of the bed portion 18 It is essential to fold the end sections in this manne because the heights of the sidewalls 32–38 are fixed.

In operation, assume the body support 10 has bee assembled from the blank 11 and is in its extended o longest configuration as shown in FIG. 5. Before a loa is placed on the bed portion 18, the side walls 32–38 ar generally upright and the V-shaped connecting link 2 terminates above the bottom wall 20 of the casket 12 a shown in FIG. 3. The panels 26 and 28, by virtue c their construction from the semi-rigid paperboard are bendable when a body is placed on the bed portion 18. Thus, as seen in cross section in FIG. 4, the panel 26 will curve or bow under the weight of a body 14. Longitudinal score lines 88 are formed in the panels 26 and 28 to properly center the body 14 as it collapses the top panels 26 and 28. The clearance below the connecting link section 24 enables it to bow under the weight of the body 14 until it engages the bottom 20 of the casket 12 where it will then provide added support for the body 14. Also, the clearance below the connecting bridge 24 enables a uniform bending of the bed portion 18 when a body 14 is placed thereon, as illustrated in FIG. 5.

The score lines 40 in the side walls 32–38 enable the side walls to flex or buckle outwardly when a body is placed on the body support 10 as can be seen in FIGS. 3 and 4. The outward flexing of the side walls 32–38 presses them against the interior side walls 16 of the casket thereby constraining sideways movement of the body support 10 in the casket 12. The score lines 40 are positioned above the mid-portion of the side walls 32–38 so as to provide for the proper outward flexing of the side walls 32–38.

From the above description, it can be seen that an improved body support 10 is provided. The body support 10 is formed from a single sheet of corrugated paperboard and can be easily assembled to fit in caskets having a variety of lengths. Thus, the casket manufacturer need not maintain inventory of different types of body supports. Also, the body support can be stored in its pre-assembled condition thereby requiring little space for the storage of numerous body supports. The outward flexing of the side walls under the load of a body ensures the secure positioning of the body in the casket. Finally, the body support of the present invention is inexpensive to manufacture and yet fulfills the service requirements established for such body supports.

It is claimed:

1. A body support for use in a casket to support a body in a recumbent position, said body support comprising a bed portion of semi-rigid sheet material having a plurality of transversely extending score lines enabling said bed portion to be folded along selected one or more of said score lines to provide integral length adjustable means operable to vary the effective length of said bed portion so that said body support can be adapted to be accommodated in caskets having different interior lengths.

2. The body support according to claim 1, wherein said bed portion includes a bed surface positionable in a generally horizontal attitude, means supporting the bed surface at a predetermined elevation above a support base on which said body support is placed, said length adjustable means being operable to vary the length of said bed surface while essentially maintaining the height of said bed surface at a predetermined elevation.

3. A body support for use in a casket to support a body in a recumbent position, said body support comprising a bed portion having integral length adjustable means operable to vary the length of said bed portion so that said body support can be adapted to be accommodated in caskets having different interior lengths, said bed portion including a bed surface positionable in a generally horizontal attitude, means supporting the bed surface at a predetermined elevation above a support base on which said body support is placed, said length adjustable means being operable to vary the length of said bed portion while essentially maintaining the height of said bed surface at a predetermined elevation, said length adjustable means including a first flexible section integrally connected to said bed portion at one end thereof and movable between a first position in general horizontal alignment with said bed surface and a second position wherein said first flexible section is displaced angularly from its first position to shorten said bed portion.

4. The body support according to claim 3, wherein said length adjustable means further includes a second flexible section connected to said first flexible section and movable between a generally upright position when said body portion is extended and to an angularly displaced position when said body portion is shortened.

5. The body support according to claim 4, wherein said bed portion is formed from a unitary blank of semi-rigid sheet material, and wherein said length adjustable means includes transversely extending score lines defining said first and second flexible sections thereof.

6. The body support according to claim 5, wherein said length adjustable means further includes an intermediate section connecting said first and second flexible sections.

7. The body support according to claim 6, wherein additional transversely extending score lines are formed in said bed portion to provide additional flexible sections between said first and second flexible sections whereby said bed portion can be folded at selected score lines to vary the length of said body support while maintaining said bed surface at said predetermined elevation.

8. A body support for use in a casket to support a body in a recumbent position, said body support comprising a bed portion having integral length adjustable means operable to vary the length of said bed portion so that said body support can be adapted to be accommodated in caskets having different interior lengths, said bed portion being formed from a unitary blank of semi-rigid sheet material and including a head section and a foot section, means connecting said head and foot sections, and depending sidewalls on said head and foot sections supporting said bed surface above a support base on which said body support is disposed.

9. The body support according to claim 8, wherein said means connecting said head and foot sections comprises a transversely extending link section extending below said bed surface and terminating at a location spaced above the support base on which said body support is disposed, said link section being responsive to the placement of a body on said bed portion to move downwardly into engagement with the support base to provide added support for the body thereon.

10. A body support for use in a casket to support a body in a recumbent position, said body support comprising a bed portion having depending sidewalls on opposite sides thereof for supporting said bed portion above a surface on which said body support is placed, at least one of said sidewalls including means enabling the outward flexing thereof in response to the placement of a body on said body support so that when said body support is disposed in a casket with said bed portion extending substantially over the width of the interior of the casket said one side wall will flex outwardly against the interior of the casket when a body is placed on said body support to restrain movement thereof in said casket.

11. The body support according to claim 10, wherein said bed portion and sidewalls are formed from a unitary sheet of semi-rigid material, and wherein said flexing means comprises a longitudinally extending score line formed in said one sidewall enabling said one sidewall to buckle outwardly against the casket to restrain sideways movement of said body support.

12. A body support for supporting a body in a recumbent position in a casket, said body support comprising a bed portion formed from a unitary blank of paperboard, said bed portion being disposable in a generally horizontal position having depending sidewalls extending downwardly for supporting said bed portion at a predetermined position above a surface on which said body support is placed, integral length adjustable means at least at one end of said bed portion operable to vary the length of said body support while essentially maintaining said bed portion at said predetermined position so that said body support can be adapted to be accommodated in caskets having different interior lengths, whereby said bed portion extends substantially over the entire length of the interior of the casket in which the body support is placed, at least one of said sidewalls having means enabling it to flex outwardly in response to the placement of a body on said bed portion so that said one sidewall can press against the interior of the casket in which the body support is placed to restrain said body support from sideways movement.

13. A body support for use in a casket to support a body in a recumbent position, said body support comprising a bed portion formed from a unitary blank of paperboard, said bed portion being disposable in a generally horizontal position and having depending sidewalls extending downwardly for supporting said bed portions at a predetermined position above a surface upon which said body support is placed, said bed portion comprising a head section and a foot section, each of said sections comprising a generally flat panel of said paperboard, a V-shaped transverse connecting link connecting said front and head sections, said connecting link extending downwardly below said panels and terminating above the surface supporting said body support, said connecting link being moved into engagement with the support surface in response to the placement of a body on said bed portion to restrain a further lowering of the body in the casket.

* * * * *